US010139065B2

(12) United States Patent
Li

(10) Patent No.: US 10,139,065 B2
(45) **Date of Patent: *Nov. 27, 2018**

(54) IMITATION CANDLE AND FLAME SIMULATION ASSEMBLY WITH MULTI-COLOR ILLUMINATION

(71) Applicant: Xiaofeng Li, Shenzhen (CN)

(72) Inventor: Xiaofeng Li, Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/804,235

(22) Filed: Nov. 6, 2017

(65) Prior Publication Data

US 2018/0094785 A1 Apr. 5, 2018

Related U.S. Application Data

(63) Continuation of application No. 15/368,168, filed on Dec. 2, 2016, now Pat. No. 9,810,388.

(51) Int. Cl.

| | |
|---|---|
| ***F21S 10/04*** | (2006.01) |
| ***F21S 6/00*** | (2006.01) |
| ***F21S 9/02*** | (2006.01) |
| ***F21V 5/04*** | (2006.01) |
| ***F21V 23/04*** | (2006.01) |
| ***H05B 33/08*** | (2006.01) |
| ***H05B 37/02*** | (2006.01) |
| *F21W 121/00* | (2006.01) |
| *F21Y 113/10* | (2016.01) |

(52) U.S. Cl.

CPC ..... *F21S 10/046* (2013.01); *F21S 6/001* (2013.01); *F21S 9/02* (2013.01); *F21V 5/048* (2013.01); *F21V 23/04* (2013.01); *H05B 33/0845* (2013.01); *H05B 33/0872* (2013.01); *H05B 37/0227* (2013.01); *H05B 37/0272* (2013.01); *F21V 23/0485* (2013.01); *F21W 2121/00* (2013.01); *F21Y 2113/10* (2016.08)

(58) Field of Classification Search

None

See application file for complete search history.

(56) References Cited

U.S. PATENT DOCUMENTS

| | | | | |
|---|---|---|---|---|
| 4,394,603 A * | 7/1983 | Widmayer | ..... | H05B 41/42 315/105 |
| 7,038,398 B1 * | 5/2006 | Lys | ..... | B60Q 1/2696 315/291 |
| 7,038,399 B2 * | 5/2006 | Lys | ..... | H05B 33/0809 315/291 |
| 8,049,688 B2 * | 11/2011 | Yu | ..... | G09F 9/33 345/156 |

(Continued)

FOREIGN PATENT DOCUMENTS

| | | |
|---|---|---|
| WO | 2007002560 A1 | 1/2007 |
| WO | 2014139483 A1 | 9/2014 |

*Primary Examiner* — Douglas W Owens
*Assistant Examiner* — Srinivas Sathiraju
(74) *Attorney, Agent, or Firm* — Perkins Coie LLP

(57) ABSTRACT

Imitation candle devices and systems with enhanced features enable simulation of a realistic candle flame using multiple angled light sources that illuminate a surface area of a movable imitation flame element in a controlled manner. In some implementations, the imitation candle devices further include a color detection module that adjust the color of the imitation candle device based on a sensed color of the surface a surface that the candle rests upon.

19 Claims, 15 Drawing Sheets

(56) References Cited

U.S. PATENT DOCUMENTS 8,217,567 B2 * 7/2012 van de Ven ..... F21K 9/00 313/501
8,258,709 B2 * 9/2012 Moskowitz ..... H05B 33/0827 315/152
8,390,205 B2 * 3/2013 Li ..... H05B 33/0827 315/152
8,436,556 B2 * 5/2013 Eisele ..... H05B 33/0857 315/152
8,456,092 B2 * 6/2013 Knapp ..... H04L 12/43 315/152
8,471,496 B2 * 6/2013 Knapp ..... H04L 12/43 315/150
8,836,243 B2 * 9/2014 Eisele ..... H05B 33/0857 315/152
9,033,553 B2 * 5/2015 Li ..... F21S 10/04 362/311.01
9,125,257 B2 * 9/2015 Eisele ..... H05B 33/0857
9,335,210 B2 * 5/2016 Li ..... G01J 1/16
9,371,972 B2 * 6/2016 Li ..... F21S 10/04
9,560,714 B1 * 1/2017 Hjerde ..... H05B 33/086
9,605,824 B1 * 3/2017 Li ..... F21S 10/04
9,810,388 B1 * 11/2017 Li ..... F21S 6/001
2007/0002560 A1 * 1/2007 Gutstein ..... F21S 6/001 362/161
2007/0159422 A1 * 7/2007 Blandino ..... A01M 1/2033 345/82
2007/0236947 A1 * 10/2007 Jensen ..... F21S 6/001 362/392
2008/0074875 A1 * 3/2008 Jensen ..... F21S 6/001 362/240
2011/0084614 A1 * 4/2011 Eisele ..... H05B 33/0857 315/152
2012/0187849 A1 * 7/2012 Hikmet ..... G01J 1/06 315/152
2012/0206050 A1 * 8/2012 Spero ..... B60Q 1/04 315/152
2012/0306380 A1 * 12/2012 Adler ..... F21S 2/00 315/152
2012/0306381 A1 * 12/2012 Adler ..... F21S 2/00 315/152
2013/0093330 A1 * 4/2013 Pance ..... H05B 33/086 315/152
2013/0139437 A1 * 6/2013 Maxik ..... H05B 37/02 47/58.1 LS
2013/0229114 A1 * 9/2013 Eisele ..... H05B 33/0857 315/152
2014/0035483 A1 * 2/2014 Becker ..... F21S 9/02 315/294
2014/0077706 A1 * 3/2014 Aldrich ..... G01J 3/46 315/153
2014/0225514 A1 * 8/2014 Pickard ..... H05B 33/0857 315/152
2014/0286024 A1 * 9/2014 Li ..... F21S 10/04 362/392
2014/0312777 A1 * 10/2014 Shearer ..... H05B 33/0869 315/151
2015/0078007 A1 * 3/2015 Li ..... F21S 10/04 362/311.02
2015/0102730 A1 * 4/2015 Eisele ..... H05B 33/0857 315/152
2016/0057829 A1 * 2/2016 Li ..... H05B 33/0827 315/313
2016/0305624 A1 * 10/2016 Li ..... F21S 10/04

* cited by examiner

| S0 | S1 | Output frequency ratio |
|---|---|---|
| L | L | Power Off |
| L | H | 2% |
| H | L | 20% |
| H | H | 100% |

| S2 | S3 | Filter Type |
|---|---|---|
| L | L | Red |
| L | H | Blue |
| H | L | N/A |
| H | H | Green |

IMITATION CANDLE AND FLAME SIMULATION ASSEMBLY WITH MULTI-COLOR ILLUMINATION

RELATED APPLICATIONS

This patent document claims priority to U.S. patent application Ser. No. 15/368,168, filed on Dec. 2, 2016, which further claims priority to PCT International Application No. PCT/CN2016/096859 filed Aug. 26, 2016. The entire contents of the before mentioned patent application is incorporated by reference in this patent document.

FIELD OF INVENTION

The subject matter of this patent document relates to candle devices that use an imitation flame, and particularly, to features that enhance the use and realistic appearance of imitation candle devices.

BACKGROUND

An electronic candle (sometimes referred to as an electronic candle or an LED candle) has evolved from a simple model that simulates the shape of a candle using an LED light to more sophisticated models with advanced features such as additional flame colors and additional styles. With no open flame or hot melted wax, flameless candles provide a longer-lasting, safe, and clean alternative to real candles, and, at the same time, can be used an ornaments, and for creating various lighting options.

Some electronic candles use a movable flame element, which when illuminated by light from a light source, such as an LED, provides an illusion of a flickering candle flame. In other electronic candles, the flame element can be stationary and a flickering flame effect is simulated by, for example, changing the manner in which the flame element is illuminated.

SUMMARY OF CERTAIN EMBODIMENTS

The disclosed embodiments relate to devices and methods for producing a more realistic flame element for use in imitation candle devices. The disclosed embodiments further facilitate the operations and usage of electronic candle devices.

In one exemplary aspect, a light-emitting control assembly for use in an electronic candle is disclosed. The assembly comprises a plurality of light producing devices, each of the plurality of light producing devices, positioned at an angle with respect to a vertical axis that passes through center of the light-emitting control assembly, projecting light for illuminating a particular area of a flame element, the plurality of light producing devices positioned to project a set of partially overlapping light beams; and a circuit board comprising a microcontroller coupled to the plurality of light producing devices and the flame element to simulate an appearance of a moving flame upon projection of the overlapping light beams on the flame element.

In another exemplary aspect, an imitation candle device is disclosed. The imitation candle device comprises a flame element shaped to resemble a candle flame and protruding from top of the imitation candle device; a plurality of light producing devices located within the imitation candle device, each of the plurality of light producing devices, positioned at an angle with respect to a vertical axis that passes through center of the imitation candle device, projecting light for illuminating a particular area on the flame element, the plurality of light producing devices positioned to project a set of partially overlapping light beams; a color sensor to detect a color of a surface that the imitation candle device is placed on; and an electronic circuitry coupled to the plurality of light producing devices and the flame element to simulate an appearance of a moving flame upon projection of the overlapping light beams on the flame element, wherein the electronic circuitry is further coupled to the color sensor to receive the detected color of the surface and coupled to a plurality of color lights to adjust color of the imitation candle device based on the detected color.

DETAILED DESCRIPTION OF CERTAIN EMBODIMENTS

In this patent document, the word "exemplary" is used to mean serving as an example, instance, or illustration. Any embodiment or design described herein as "exemplary" is not necessarily to be construed as preferred or advantageous over other embodiments or designs. Rather, use of the word exemplary is intended to present concepts in a concrete manner.

Imitation candle devices can simulate a real candle with a flame that resembles a real-life flame with flickering effects using optical, mechanical and electrical components. The disclosed embodiments relate to features that enhance the appearance of a real candle flame, and further facilitate the operations of imitation candle devices, and expand the functionalities of such devices.

Figure 1:
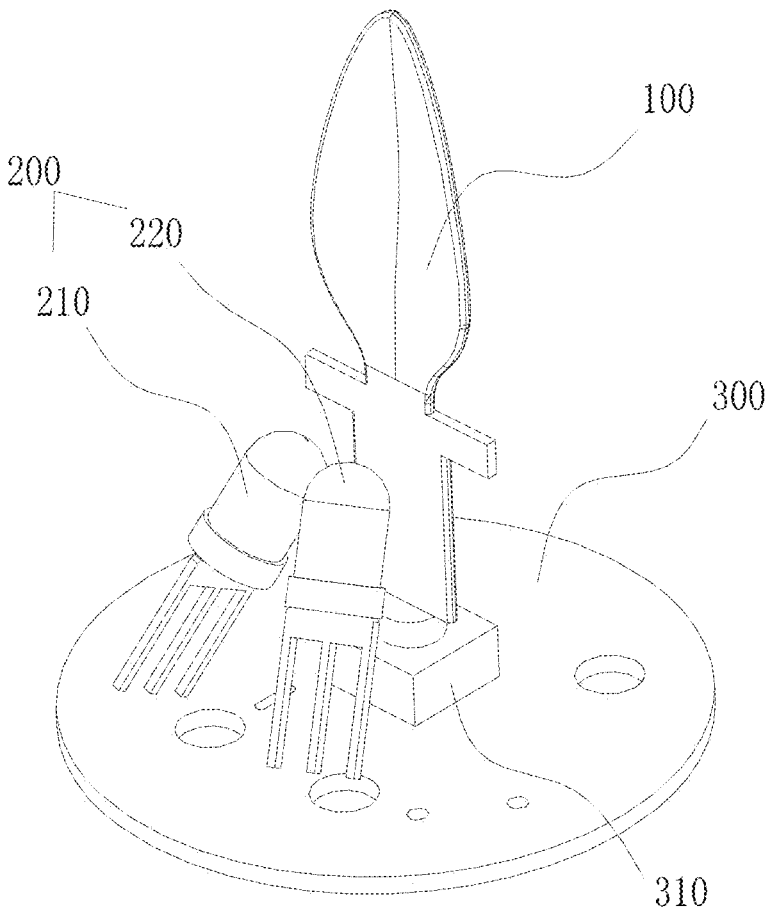
FIG. 1 illustrates an exemplary flame simulation assembly.

The devices and components that are shown in FIGS. 1-8 provide examples of some imitation flame devices and associated components that can accommodate and benefit from the disclosed embodiments. Referring to FIG. 1, an exemplary flame simulation assembly is shown that includes a flame element 100 that is shaped to resemble a flame, at least one light source 200 that is used to simulate flame, and a circuit board 300 that controls the light source 200 connected thereto. The flame element 100 is disposed on top of a switch 310 that is connected to the circuit board 300. An operator may trigger the touch switch 310 by moving (e.g., pressing down on) the flame piece 100, without a need to hold the electronic candle, which makes this on-off mechanism very convenient. Moreover, the use of the flame element 100 as a control switch improves the appearance of the imitation candle device since no external buttons or switches are needed.

In the configuration of FIG. 1, the light source 200 includes two light producing devices 210 and 220 that are positioned to transmit light onto a surface of the flame element 100. The light producing devices 210 and 220 can illuminate different areas on the same side of the flame element 100. The circuit board 300 controls different light producing devices of the light source 200 to, for example, turn the light producing devices on or off, and to vary the brightness of the illuminated areas on the flame element 100, and to thereby create a flickering candle light effect.

The control of light producing devices 210 and 220 may be governed by the circuit board 300 according to a regular pattern, or in accordance with an irregular pattern, depending on the desired visual effects. Generally, the light producing devices 210 and 220 may be turned on or off alternatively, so that the flame element 100 looks like a flickering candle light. The intensity of the light produced by the light producing devices 210 and 220 can also be modulated by the circuit board 300. In some embodiment, the circuit board 300 is capable of communicating with a mobile application implemented on a mobile device (e.g. cell phone). The mobile application can modulate the light intensity and control the light producing devices by sending corresponding commands to the circuit board 300.

It is important to note that in describing some of the disclosed embodiments, exemplary configurations of non-movable flame elements are sometimes used to facilitate the understanding of the underlying principles. It is, however, understood that the disclose technology (such as flame illumination techniques and devices) can be used in conjunction with non-movable flame elements, as well as movable flame elements. For example, in some embodiments, where the flame element is a movable component, the movement of the flame element 100 may also be governed by the circuit board 300 according to a regular pattern, or in accordance with an irregular pattern, depending on the desired visual effects. In some embodiments, the movable flame element 100 can move according to a swinging motion.

Figure 2:
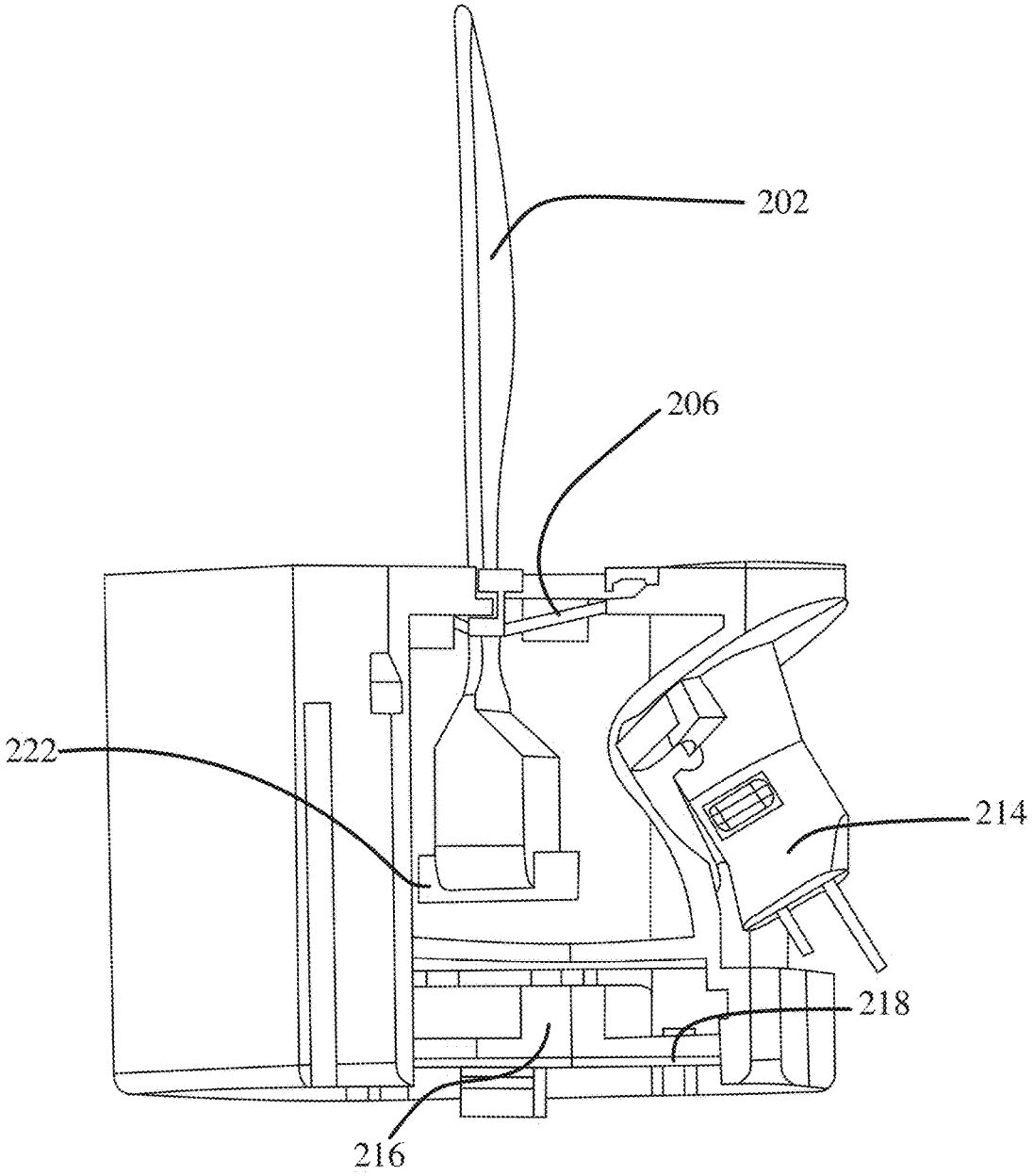
FIG. 2 shows exemplary components of the movable flame element of an exemplary imitation candled device.

For example, FIG. 2 shows additional details of the movable flame element of an exemplary imitation candle device. The flame element 202 is suspended by a wire (e.g., a steel wire) support structure 206. The bottom section of the flame element 202 below the steel wire support structure 206 can include a magnetic element 220 that interacts with a magnetic field produced by a coil 216. The coil 216 can be energized by control signals generated by electronic circuits that are located on, for example, a PCB board 218. In some implementations, the electronic circuits can generate pulses that cause the electromagnet to turn on and off, to vary the produced magnetic field strength, or to reverse polarity, at particular time instances. Due to interactions of the magnetic element 222 with the magnetic field of the coil 206, the flame element 202 can oscillate in swinging motion and produce a flickering effect when illuminated by the light produced by the one or more light source 214. In some configurations, the movement of the flame element may be additionally, or alternatively, achieve by a source of wind, such as a fan, that causes the flame element to swing under the control of signals generated by a microcontroller. In some embodiments, the flame element 202 is lighter at the top and heavier at the bottom. Because of this weight difference, once the flame element 202 starts swinging, it can sustain the motion without continuous electrical power. In some embodiments, the PCB board 218 may control the movement of the flame element 202 based on a pattern of "start-stop-start-stop." One advantageous aspect of this design is that the flame element consumes less energy. The motion of the flame element is also more natural. Each flame element may demonstrate a unique swing motion, providing a better imitation to the real candle flames. In some embodiment, a mobile application can modulate the speed of the swing motion by sending corresponding commands to the PCB board 218.

Figure 3:
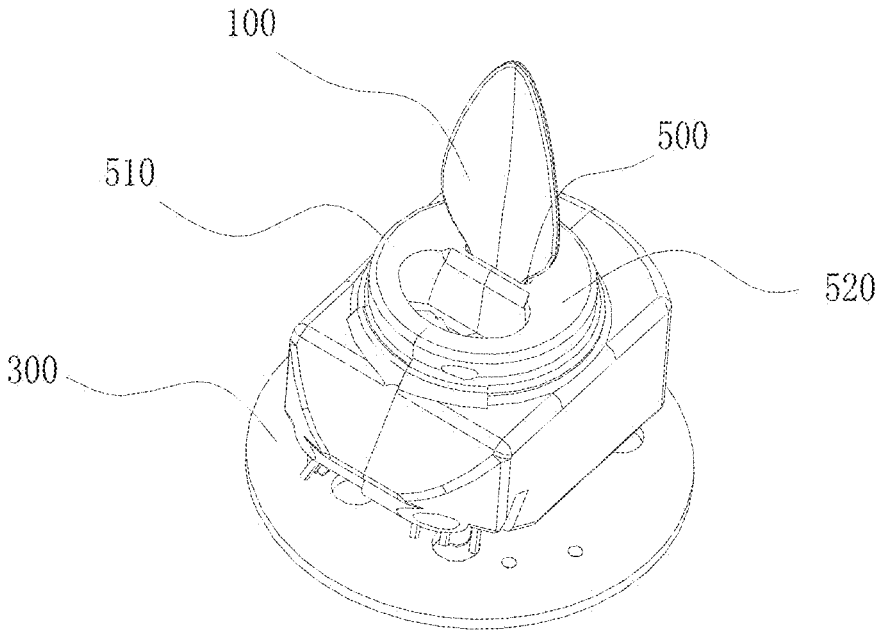
FIG. 3 illustrates an exemplary flame simulation assembly having a non-movable flame element and a mounting rack.

FIG. 3 illustrates an exemplary flame simulation assembly having a non-moving flame element and a mounting rack. In particular, FIG. 3 shows a mounting rack having a mounting cavity 500 that allows the flame element 100 to be mounted in the mounting cavity 500. In FIG. 3, the flame element 100 is disposed vertically, and the touch switch 310 is disposed under the flame element 100, below an opening at the lower end of the mounting cavity 500. The flame element 100 can be moved vertically in the mounting cavity 500. Thus, when a user pushes down on the flame element 100, the flame element 100 moves downward to trigger the switch 310. Specifically, the mounting rack includes a left bracket 510 and a right bracket 520, each having a groove such that after the left bracket 510 and the right bracket 520 are combined the flame sheet 100 can move vertically within the grooves.

Figure 4:
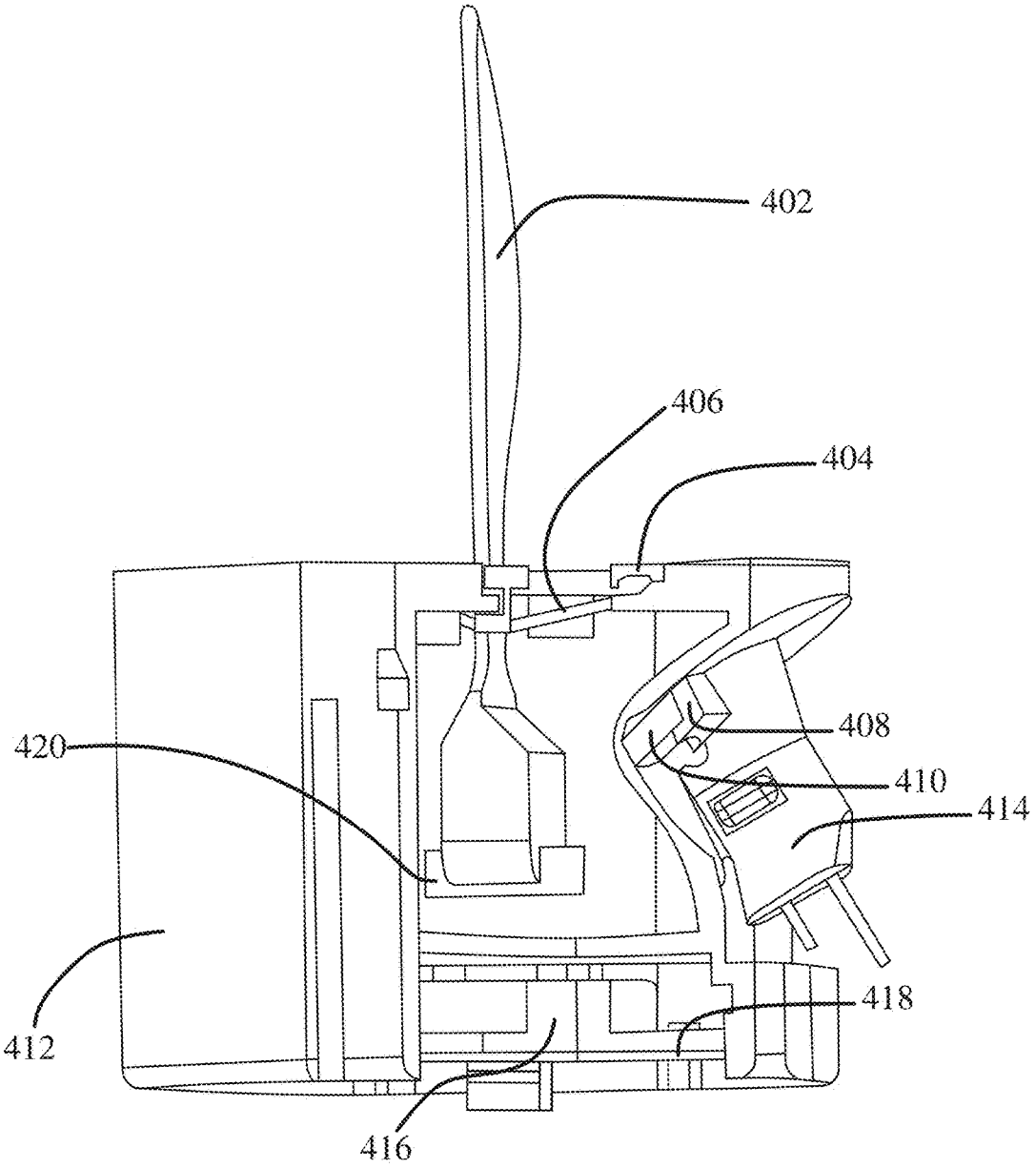
FIG. 4 illustrates components of an exemplary imitation candle device in more detail.

FIG. 4 also illustrates a ring 404 that is positioned on top of the imitation candle housing, around and in the vicinity of the flame element 402. In some embodiments, the ring 404 serves as a decorative piece to hide the internal components of the imitation candle device and/or to resemble melted wax. In this regard, the ring 404 can have a particular color and/or reflectivity to produce the desired visual effect when viewed under ambient illumination, or under the scattered and/or reflected illumination of the candle light source 414. In some embodiments, the ring 304 operates as a touch sensitive on-off switch. In particular, the ring 404 can be made of conductive material that forms a capacitive element in electrical connection with one or more components on the PCB board 418. When a user's finger contacts, or is within close proximity of, the ring 404, a capacitive contact is formed to complete a circuit. The touch-sensitive mechanism can be used for turning the candle on or off, or for controlling other functions of the imitation candle in a step-wise manner. For example, each touch can increase or decrease intensity of the light source 414, to switch the color of light, or to change a mode of operation (e.g., from flickering to constant intensity).

FIGS. 5 through 8 illustrate an exemplary imitation candle device that includes a flame element 100 and a shell 400 that covers the internal components of the imitation candle device. In particular, the shell 400 covers the base 700, the light source 200 (see, e.g., FIG. 1) and the circuit board 300. As noted earlier, a light producing device 210, 220 can include at least two light beams to illuminate different areas on at least one side of the flame element 100.

Figure 5:
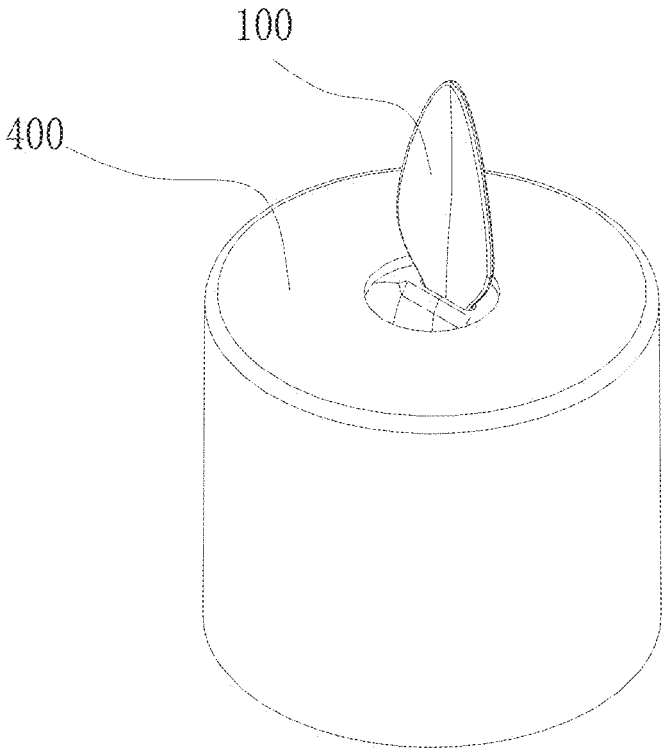
FIG. 5 illustrates an exemplary a shell that is used in an imitation candle device.
Figure 6:
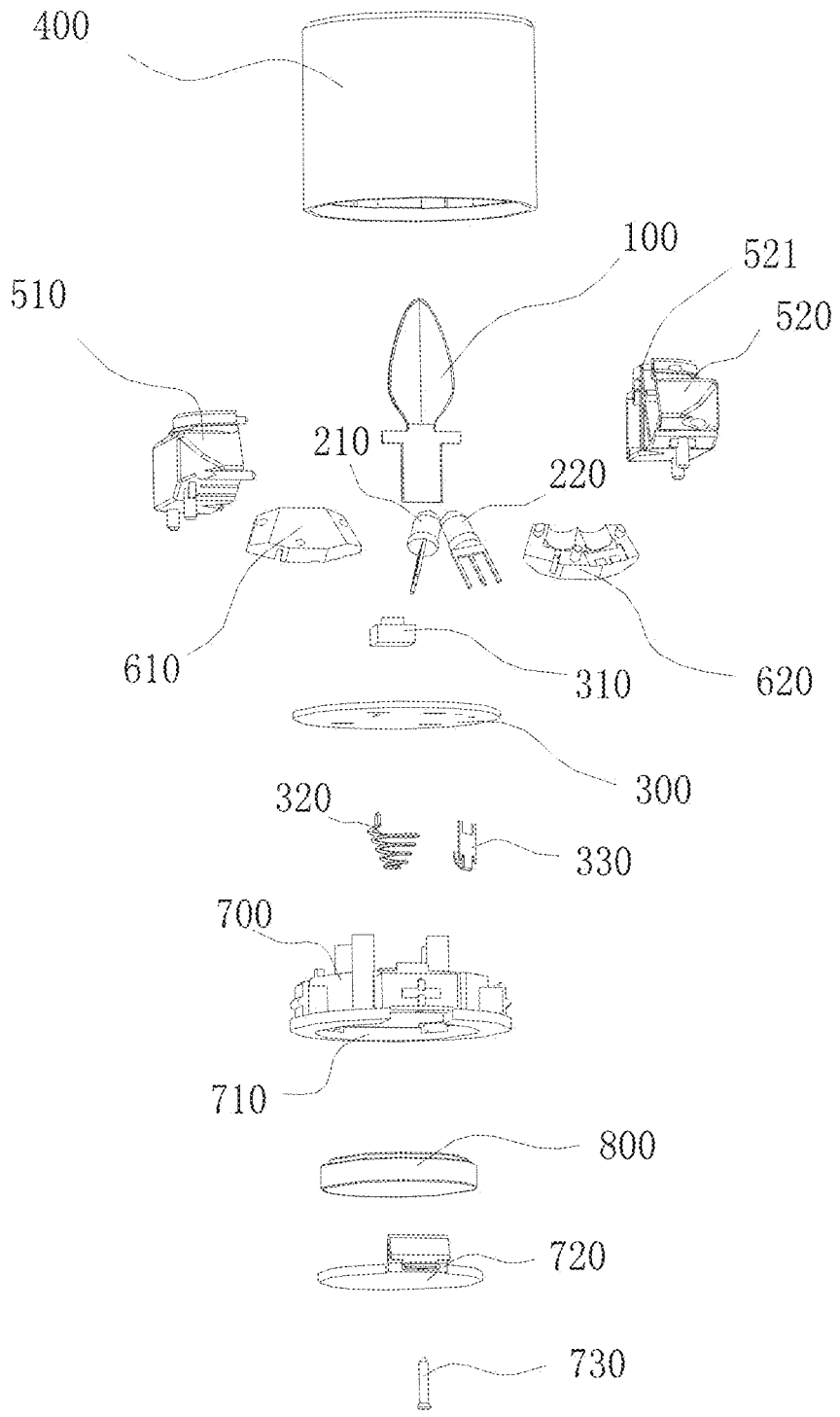
FIG. 6 illustrates exemplary components of an imitation candle device of FIG. 5.

The flame element 100 and the light source 200 are mounted on a mounting rack. As described above, the mounting rack includes a left bracket 510 and a right bracket 520 that combine to form a support structure of the light source 200 and the flame element 100. In the depicted embodiment, a holder is used to mount the light producing devices. The holder is mounted on the combined structure of the left bracket 510 and the right bracket 520, and provides a platform for mounting the light source 200. At least part of the light emitting devices 210 and 220 protrude above a cavity formed by the holder. In some embodiments, the holder may also be divided into a left holder 610 and a right holder 620 (as shown in FIG. 5); when the two holder sections are brought together, they form the cavity that accommodates the light producing devices 210 and 220.

The circuit board 300 is located under the light producing devices, and is electrically connected to the light producing devices so as to control the modulation of light produced by the light producing devices. The circuit board 300 may include a general purpose processing unit 340. Further, the circuit board 300 may include a touch switch 310. As noted earlier, the flame element 100 is disposed movably in the imitation candle device such that its swing motion mimics the motion of real flames. Also, pushing on the flame element 100 triggers the touch switch 310, causing the imitation candle device to be turned on or off.

As noted earlier, the left bracket 510 and the right bracket 520 are provided with grooves 511 and 521, so as to form a mounting cavity for the flame element 100 when the left bracket 510 and the right bracket 520 are brought together. Thus, the flame element 100 may be mounted in the mounting cavity so as to enable its vertical movement. Such a vertical movement activates or deactivates the switch 310 that is placed below the flame element 100.

The base 700 of the imitation candle device further includes a battery container 710 and a battery cover 720. The battery cover 720 is fixed with a screw 730. A battery 800 may be placed in the battery container 710. The circuit board 300 is electrically connected to the battery 800 by, for example, an anode piece 330 and a cathode piece 320, and the battery 800 supplies power for the circuit board 300 and the light source 200.

Figure 9A:
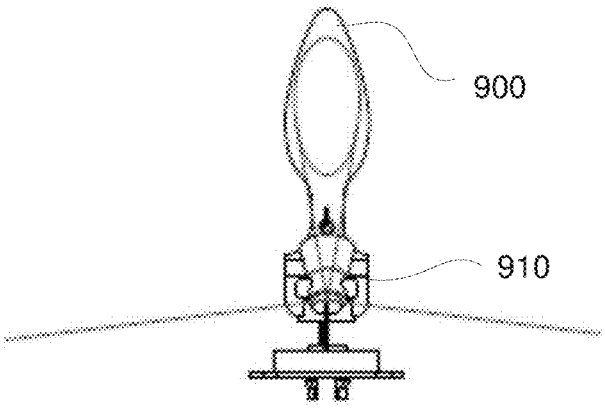
FIG. 9(A) illustrates an exemplary front view of a light producing device emitting light onto the flame element.
Figure 9B:
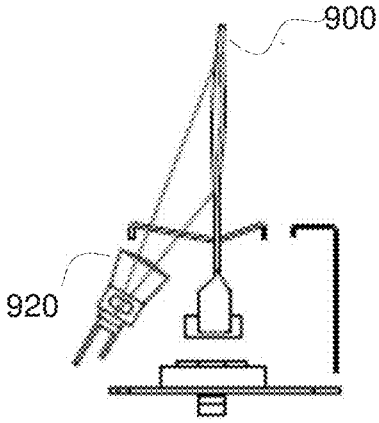
FIG. 9(B) illustrates an exemplary side view of a light producing device emitting light onto the flame element.

FIG. 9(A) shows an exemplary front view of the light producing device 910 emitting light onto the flame element 900. In this case, a movable flame element is selected to illustrate the illumination principles, but as noted earlier, the disclosed illumination systems can be readily implemented in candles having non-movable flame elements. FIG. 9(B) shows an exemplary side view of the light producing device 920 emitting light onto the flame element 900. The amount of illumination area on the flame element 900 can be adjusted based on the angle at which the light producing devices are positioned.

In some embodiments, each of the light producing devices 910 and 920 is an LED device. The color temperature range for LED devices used in imitation candles is between 1690° K to 2350° K. In some embodiments, the LED devices have a color temperature of 1740° K to 1840° K. In some embodiments, the LED devices have a color temperature of 1690° K to 1770° K.

In some embodiments, each LED device includes a plurality of chips or light emitting elements disposed therein. The light emitting elements can produce corresponding illuminations with different divergence characteristics. Because the natural candle light is tinted with color green, in some embodiments, one light emitting element produces green color while the other light emitting elements have the same, or different, colors. In some embodiments, all light emitting elements that are packaged within a light producing device have the same color. In some embodiments, all light emitting elements of the electric candle device have the same color.

One advantageous aspect of the angled position of the light producing devices is that the angles allow the emitted light beams to form an illuminated area with an overlapped section on the flame element 900. This overlapped section can be adjusted (e.g., during the manufacturing process) to be located at the center of the flame element and to have the highest intensity of the illuminated area, which resembles the real candle flames.

Figure 9C:
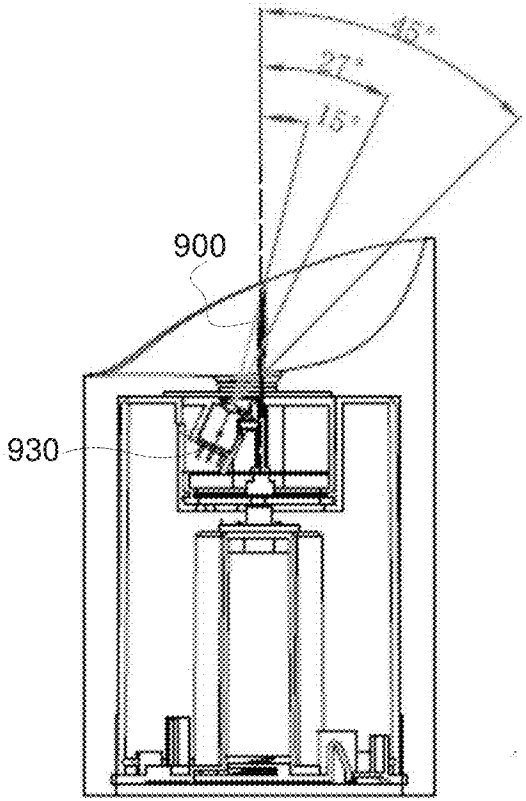
FIG. 9(C) illustrates an exemplary imitation candle device with a flame element and two light producing devices positioned in an angled configuration to illuminate the flame element.

FIG. 9(C) illustrates an exemplary side view of an imitation candle device with a flame element 900 and a light producing device 930 positioned at an angle to illuminate the flame element 900. In this embodiment, the light producing device 930 is positioned at an angle with respect to the flame element 900 such that the center of the light beam emitted by the light producing device 930 forms an angle of 27° with respect to the vertical axis that runs through the center of the imitation candle device. The upper and lower boundaries of the light beam form an angle of 15° and 45°, respectively, with respect to the vertical axis, as shown in FIG. 9(C). The specified angular divergence enables the light producing device 930 to be positioned at a particular distance below the top surface of the candle device, while illuminating the surface of the flame element 900.

Figure 9D:
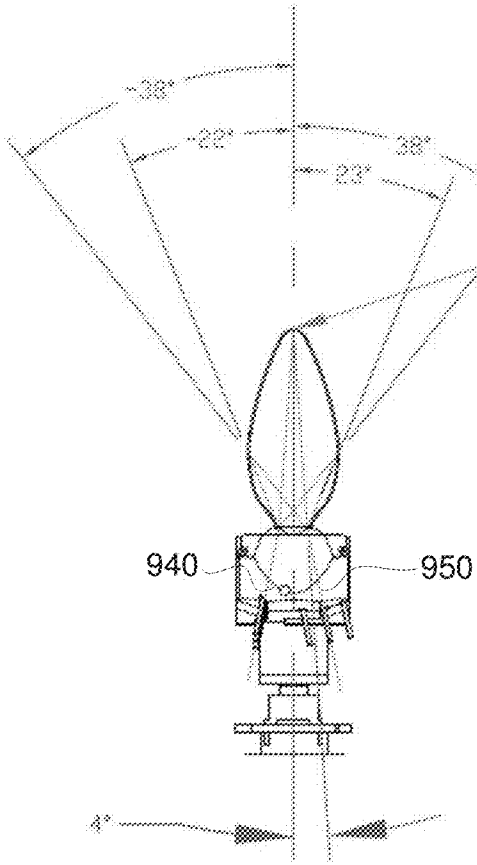
FIG. 9(D) illustrates another exemplary front view of the light producing devices emitting light onto the flame element.

FIG. 9(D) shows an exemplary front view of the light producing devices 940 and 950 emitting light onto the flame element 900. In this embodiment, the light producing devices are positioned at a front angle of 4° with respect to the vertical axis of the imitation candle device. The boundaries of the emitted light beams form a front angle of around 38° and a front angle of around 22° with respect to the vertical axis of the imitation candle device. In some embodiments, the flame element 900 is made of a translucent material that allows light that is incident thereupon to be diffused.

Figure 9E:
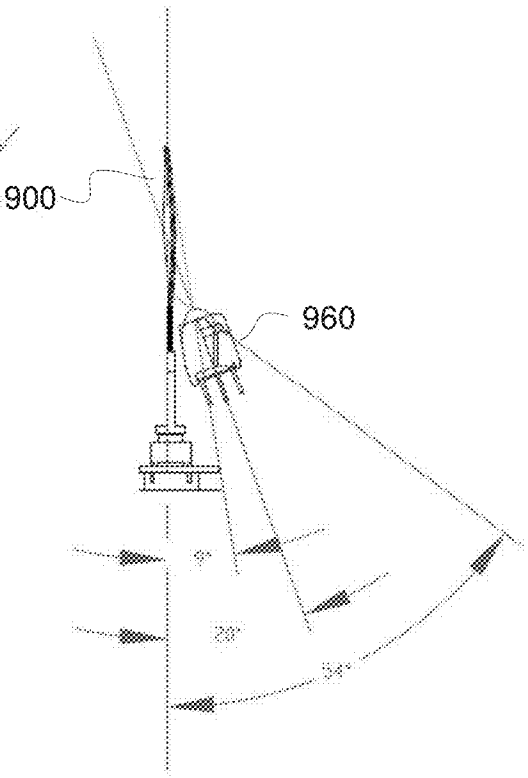
FIG. 9(E) illustrates another exemplary side view of a light producing device emitting light onto the flame element.

FIG. 9(E) shows another exemplary side view of the light producing device 960 emitting light onto the flame element 900. In this embodiment, the light producing device is positioned at a side angle of 20°. The boundaries of the emitted light beams form a side angle of 9° and a side angle of 54° with respect to the vertical axis of the imitation candle device.

In some embodiments, each LED device includes a plurality of chips or light emitting elements, resulting in a plurality of illuminated areas that can be at a distance from each other. A wide range of angle configurations for the light producing devices can ensure that the positioning of the light emitting devices and elements can maximize the size of the illuminated area on the flame element.

Figure 9G:
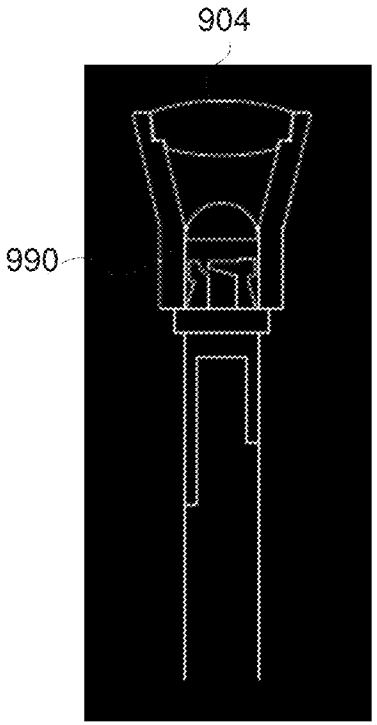
FIG. 9(G) illustrates a detailed configuration of a light producing subsystem having a lens that is placed in front of the light emitting devices.
Figure 9F:
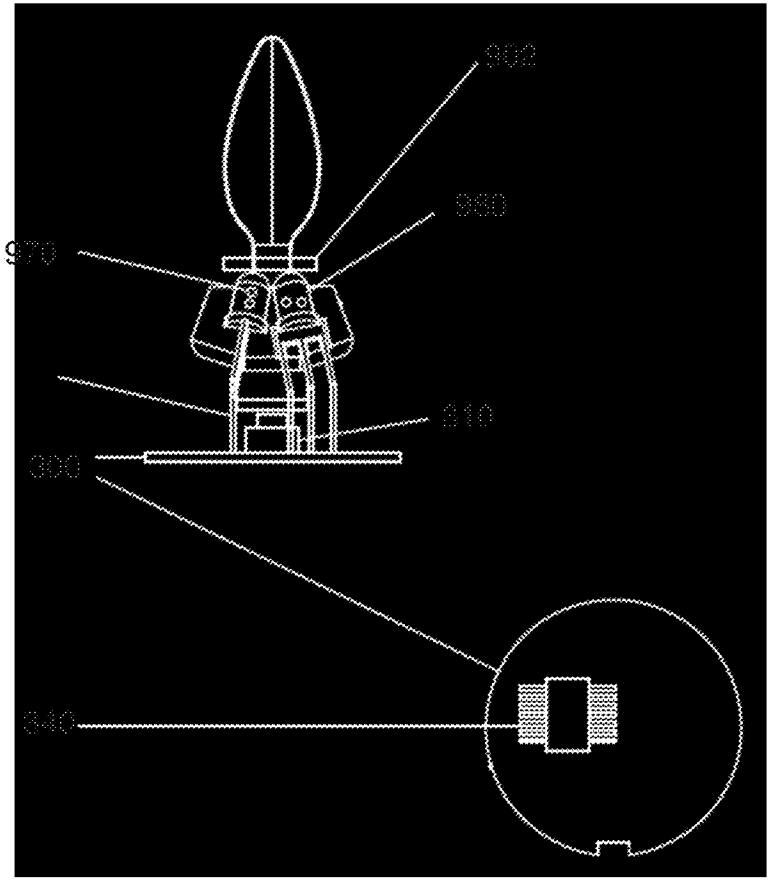
FIG. 9(F) illustrates a configuration of the flame simulation assembly that includes a lens placed in front of the light emitting devices.

FIG. 9(F) shows another configuration of the flame simulation assembly that includes a lens 902 placed in front of the light emitting devices 970 and 980. One advantageous aspect of using a lens is that it allows accurate projection of light onto the desired section of the flame element even if there are minor differences in angles at which the light emitting devices are positioned. Such advantage can reduce the cost of quality control for manufacturing and provides more consistent lighting effects for the final products. Another advantageous aspect is that the lens 902 increases the light intensity of the emitted light beams. FIG. 9(G) shows a detailed configuration of a light producing mechanism having a lens that is placed in front of the light emitting device(s). The convex lens 904 is placed above the light emitting device 990. In some embodiments, the distance between the convex lens 904 and the light emitting device 990 is within 2 mm.

Figure 10A:
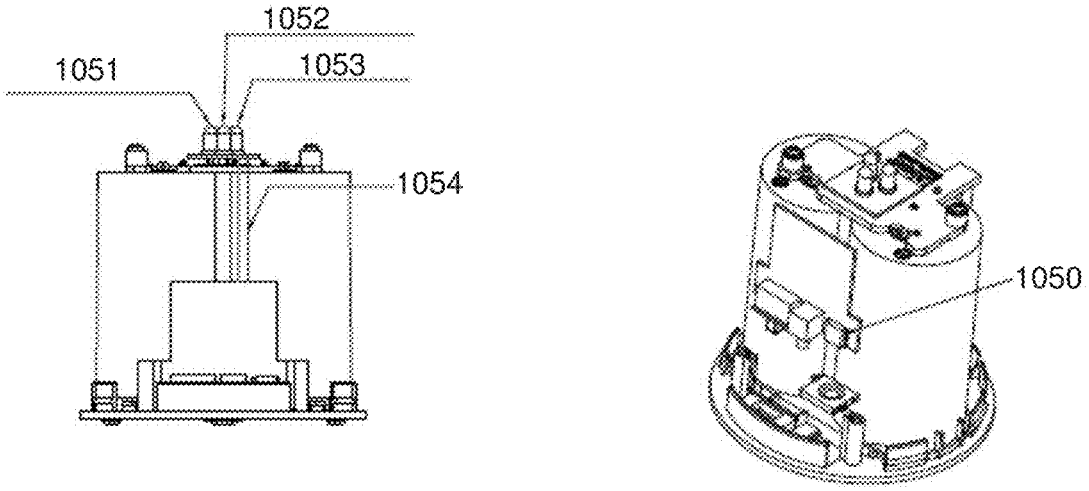
FIG. 10(A) illustrates an exemplary illumination system of a candle device that includes a color sensor.

The imitation candle device can further include a color sensor to detect the color of the surface where the imitation candle device is placed on. The color sensor facilitates the adjustment of the candle device color based the color of the surface that the candle device is placed on. FIG. 10(A) shows a color sensor 1050 that is positioned inside of the imitation candle device. In some embodiments, the color sensor also includes, or is used in conjunction with, another light emitting device (e.g., a white light LED) positioned in the imitation candle device to project light onto the surface upon which the imitation candle device rests. The emitted light propagates through an opening at the bottom of the imitation candle device to reach the surface that the imitation candle device rests upon, and the color sensor receives a portion of the reflected light and generates a signal that can be used to determine the color of the surface. The color sensor 1050 can be further coupled to three lights, as shown in FIG. 10(A): a blue (B) light 1051, a red (R) light 1052, and a green (G) light 1053 via connection cable 1054. The connection cable 1054 connects the three lights with the PCB board such that the intensity of the three lights can be adjusted based on the color sensor output.

In some embodiments, the color sensor can be coupled to a plurality of lights that are positioned to illuminate the body of the candle device. One such example is provided in FIG. 10(C), in which a plurality of lights 1006 are embedded in the outside cylinder 1004 of the candle body. FIG. 10(C) illustrates lights 1006 that are positioned on the outer periphery of the outside cylinder 1004 to provide illumination to the sidewall and/or the top surface of the outside cylinder 1004. In other configurations, fewer or additional lights 1006 may be used. In one example configuration, lights 1006 are additionally or alternatively embedded within the bottom surface of the outside cylinder 1004 to illuminate the bottom and/or sidewalls of the outside cylinder 1004. Each of the lights can include multiple light producing elements, such as blue element, a red element, and a green element. The lights are further coupled to the PCB board such that the intensity of the light elements can be adjusted based on the color sensor output. In some embodiments, the outside cylinder 1004 includes a semi-transparent material that can diffuse the light beams from the plurality of lights 1006. In some embodiments, at least one of the plurality of the lights 1006 is disposed at the center of the candle to cast light beams onto the outside cylinder 1004 from inside the candle device.

Figure 10B:
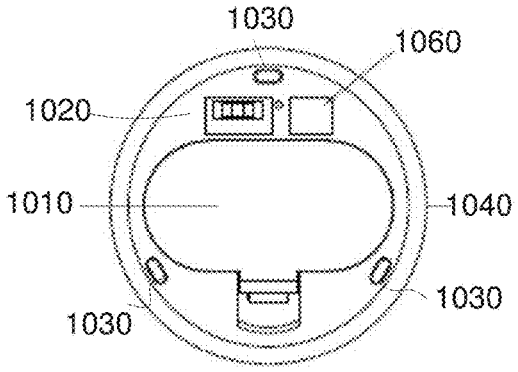
FIG. 10(B) illustrates an exemplary color sensor connected to three lights.
Figure 10C:
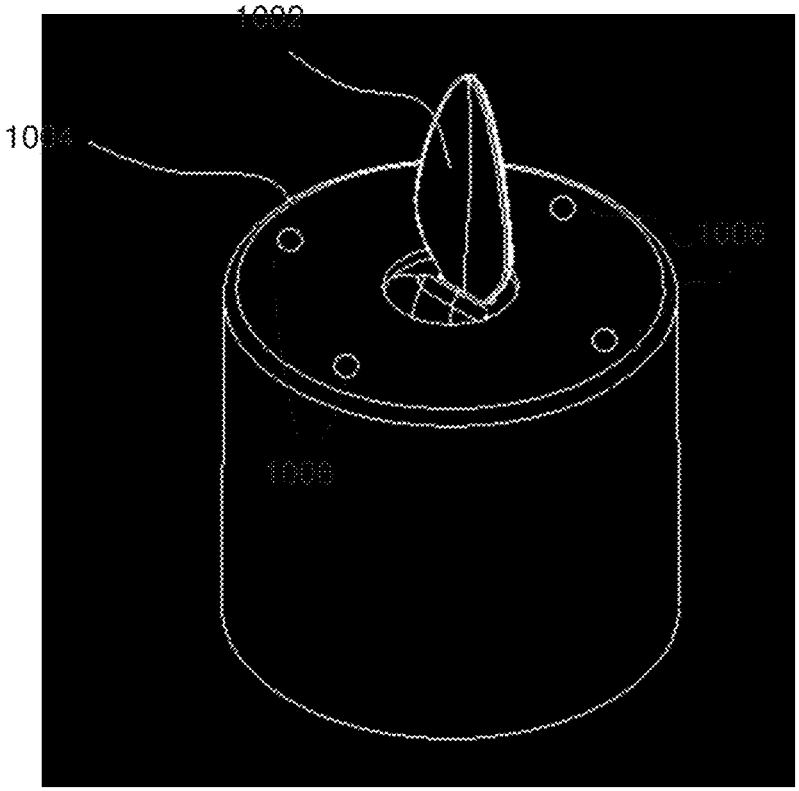
FIG. 10(C) illustrates an exemplary configuration of lights embedded in the outside cylinder of the candle body.

FIG. 10(B) illustrates a bottom view of an exemplary imitation candle device. As shown in the exemplary configuration of FIG. 10(B), the bottom section can include a battery cover 1010, a set of switches 1020 for controlling operation of the candle (e.g., on/off, timer, etc.). In some embodiments the bottom section includes a cover 1060 that allows light from the interior of the candle body to propagate there through and reach the outside of the candle device. For example, the cover can be transparent or semitransparent. If the candle device is resting on a surface, the light that propagates through the cover 1060 impinges on the surface and at least a portion of light is reflected back into candle device, to reach the color sensor 1050. The color sensor can detect the color of the surface from the reflected light, which in turn enables color of the candle device to be properly adjusted, as will be descried below. FIG. 10(B) further illustrates three protrusions (or legs, or stands) 1030 that are positioned close to the periphery of the bottom section and are evenly spaced from one another. The legs 1030, which have relatively small dimensions, provide several advantageous features. First, the legs provide a small gap between the bottom section of the candle device, and specially the wax-like outer sleeve 1040, and the surface on which the candle is placed. This way, any staining of the surface (e.g., due to prolonged contact with wax-like shell) is avoided. Second, the legs provide a balanced support for the heavy components in the middle section of the candle device (e.g., batteries and associated components), and prevent such heavy components from separating from the remaining sections of the candle device.

Figure 10D:
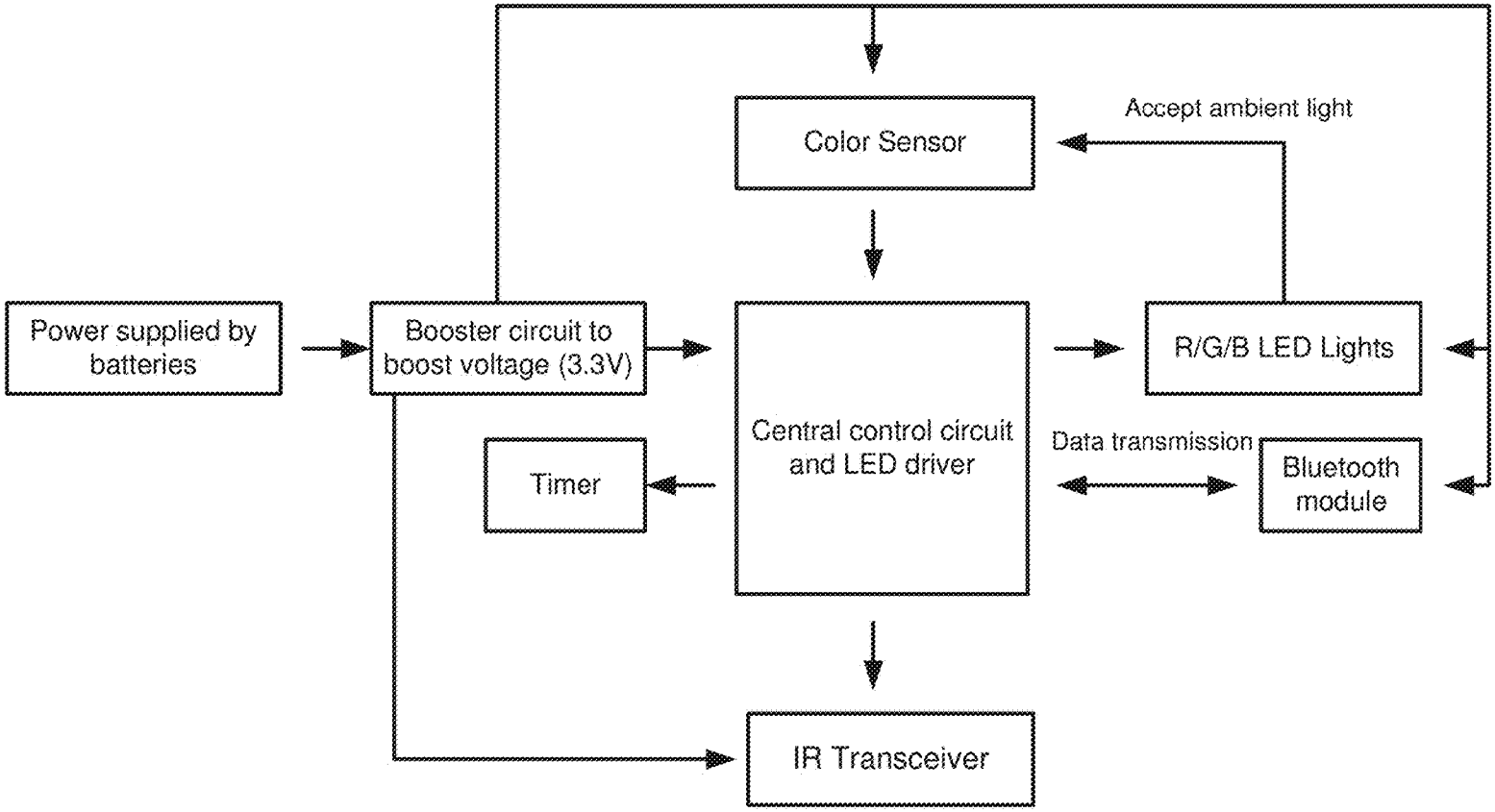
FIG. 10(D) shows an exemplary flowchart illustrating the overall process of color detection and adjustment.

FIG. 10(D) is a flowchart illustrating overall process of color detection and adjustment in accordance with an exemplary embodiment. The batteries in the battery container provide power for the whole circuit. A booster circuit is connected to the batteries in order to achieve a consistent 3.3V voltage for the central control circuit. The color sensor communicates to the central control circuit information and/or signals that are indicative of the detected color of the bottom surface. The central control circuit then adjusts the color of the candle using its LED driver.

In some embodiments, the central control circuit is further equipped with two types of communication modules to receive signals from the color sensor: the infrared (IR) transceiver and the Bluetooth module. In some embodiments, only one communication module needs to be activated at a time. The color sensor can inform the central control circuit, via either IR or Bluetooth, of the detected color. The central control circuit then changes the color of the candle device to match the color of the bottom surface.

The color detection module is configured to operate by implementing techniques that utilize primary colors characteristic. The perceived color of an object is due to the characteristics of the illuminating light and the object. Specifically, the object typically absorbs a portion of the irradiating light (e.g., sunlight) while reflecting another portion of the light into the human eyes. White light is a mixture of visible light of various frequencies. It contains a variety of colors, such as red (R), green (G), and blue (B). The Young-Helmholtz theory suggests that various colors can be obtained by mixing different proportions of the three primary colors (red, green, and blue). Therefore, if the ratio of the three primary colors is known, it is possible to know the color of an object. In order to determine the amount of a particular primary color, a bandpass filter can be placed in front of the sensor that allows only a particular color (i.e., a particular range of light frequencies or wavelengths) to pass through to the detector. For example, when a "red" filter is selected, only the red portion of the received light can pass to the sensor module, while no appreciable amount of blue or green light is allowed to pass. The sensor can then determine the intensity of the red light. Similarly, by replacing the red filter with other colored filters, the sensor can determine the intensity of green and blue lights when respective filters are selected. Based on these three intensity values, the sensor can determine the color of the bottom surface.

In some embodiments, the color sensor further takes into account white balance. White balance is the process of removing unrealistic color casts, so that objects which appear white in person are rendered white. In theory, the white light is mixed from equal amount of red, green, and blue light. In reality, the amount of primary colors in white light is not equal. The sensitivity of human eyes to each primary color is different, so the color sensor has unequal output for each of the RGB color channels.

The process of conducting white balance may involve three steps. First, an empty tube is placed above the color sensor. The empty tube contains a white light source that projects light onto the base surface to be reflected onto the color sensor. Second, the color sensor selects red, green, and blue filters sequentially and detects the corresponding light intensities. In the last step, the central circuit computes three adjustment parameters of each color channel for future light detection and adjustment.

There are at least two ways to compute the adjustment parameters. The first way is to sequentially select the filter for each color channel and count the pulse output from the color sensor. The count stops at 255 for each color channel, and the timer records the amount of time used to reach 255 counts for each color. These time periods are now taken as reference values for future color detection.

The other way to compute the adjustment parameters is to use a set time period (e.g. 10 ms) in the timer. The central control circuit then counts the number of pulses for each channel output during this set time period. The central control circuit computes a ratio such that the number of pulses times the ratio equals to 255. For future color detection, the corresponding R, G, B values are computed by multiplying the ratio with the actual count values.

Figure 10F:
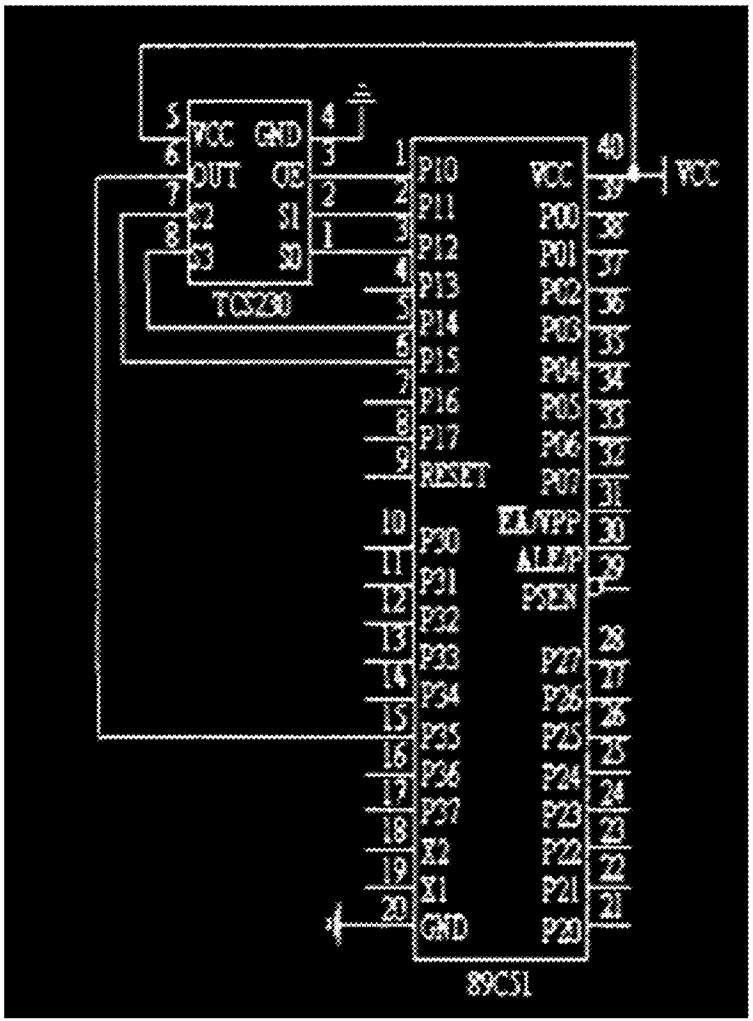
FIG. 10(F) illustrates an exemplary circuit design of the color detection module.
Figure 10E:
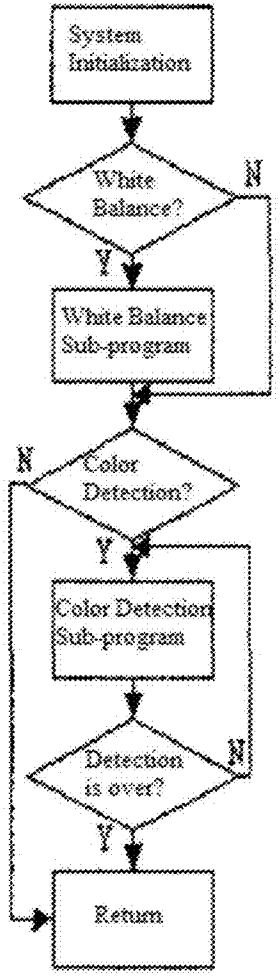
FIG. 10(E) shows a exemplary flowchart of color detection and white balance process.

FIG. 10(E) is a flowchart illustrating an exemplary process of color detection and white balance. System initialization comprises resetting timer, selecting the work mechanism of counter, and selecting output ratio and other communication parameters. After initialization completes, the central circuits determines if white balance is needed. If so, it executes white balance procedures. Otherwise, it determines if color detection is needed. If so, it executes the steps for color detection until the detection completes.

FIG. 10(F) shows exemplary electronic circuitry for implementing the color sensor. In this exemplary configuration, the output of the color sensor (e.g., TCS230) is a square wave (50% duty cycle) with frequency that is directly proportional to light intensity (irradiance). Such output pin is coupled to a timer of the central control circuit (e.g., 89C51). The timer is first initialized to a set value. During color detection, the central control circuit counts the output pulses for each color channel and multiplies the values with adjustment parameters from white balance in order to determine the R/G/B value of the bottom surface.

Figures 10G, 10H:
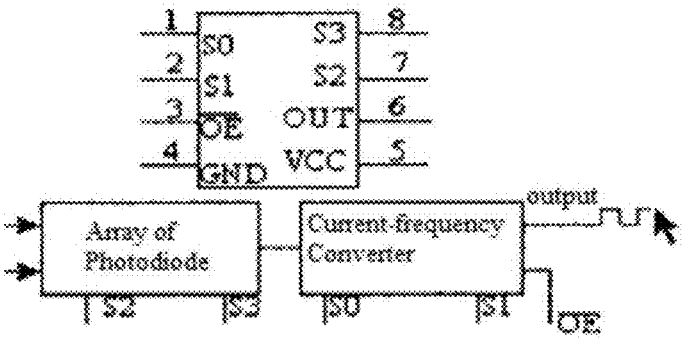
FIG. 10(G) illustrates a exemplary functional block diagram of the integrated circuit (IC) of the color detection module.
FIG. 10(H) illustrates exemplary combinations of pin S0, S1, S2, and S3 in the color detection module.

FIG. 10(G) shows a functional block diagram of the integrated circuit (IC) of the exemplary color sensor of FIG. 10(F). S0 and S1 select the output ratio or power-off mode for the sensor. S2 and S3 select filter type. OE is the output enable pin that controls the output state. When there are multiple inputs sharing the same input pins, OE can also be used as the chip select pin. OUT is the frequency output pin. GND is the chip ground pin. VCC provides working voltage for the chip.

In some embodiments, the color sensor is implemented using a programmable light-to-frequency converter. As depicted in FIG. 10(F), a configurable silicon photodiode array and a current-frequency converter are integrated in a single complementary metal-oxide-semiconductor (CMOS) circuit. In some embodiments, the circuit also integrates three RGB filters. These filters can be color sensing devices with digital compatible interfaces, one for each of the R/G/B color channels. The output of the color sensor is square waves (pulses) in digital form to drive standard TTL or CMOS inputs. Because digital output can achieve an accuracy of ten digits or more for each color channel, it is not necessary to introduce analog signals or to include an Analog/Digital conversion circuit, thereby reducing the complexity of the overall circuit design.

In some embodiments, the IC of the color sensor adopts an 8-pin SOIC surface mount packaging, integrating 64 photodiodes on a single chip. These photodiodes are classified into four categories: sixteen photodiodes having red filters, sixteen photodiodes having green filters, sixteen photodiodes having blue filters, and the remaining sixteen photodiodes having no filter. The photodiodes are staggered within the chip to minimize unevenness of the incident radiation. Such advantageous design increases the accuracy of color detection. Moreover, photodiodes using the same color filter are connected in parallel and evenly distributed in the diode array, eliminating possible position errors for color detection.

In some embodiments, when the color sensor is in operation, two programmable pins in the 8-pin surface mount select color filters dynamically, with sensor output frequency ranging from 2 Hz to 500 kHz. The two programmable pins can also be used to select among power-off mode, 100%, 20%, or 2% output ratio.

As depicted in FIG. 10(H), when incident light is projected onto the color sensor, different filters can be selected based on different combinations of control pins photodiodes S2 and S3. After the input passes the current-frequency converter, the color sensor outputs square waves (pulses) of different frequencies with a duty cycle of 50%. By controlling the output ratios using S0 and 51 pins, the sensor can further adjust the output frequency range to suit different needs.

One advantageous aspect of the color sensor described above is that the module is a simple structure with high detection accuracy and efficiency. The sensor is capable of communicating with the central control circuit of the candle and transmitting the detected color to adjust the color of the candle device.

In some embodiments, the candle device is capable of communicating with a mobile application implemented on a mobile device (e.g. cell phone). Users, via the user interface of the mobile application, can select a particular color for the candle device. The selected color is communicated to main circuit board and in turn used to change the colors of light from the light producing devices.

Figure 7:
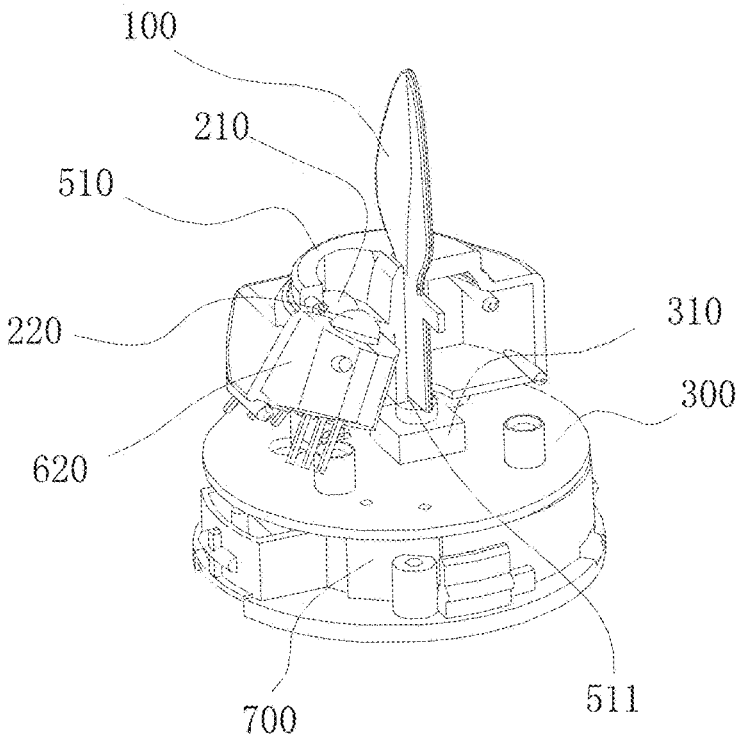
FIG. 7 illustrates certain exemplary components of a partially-assembled imitation candle device.
Figure 8:
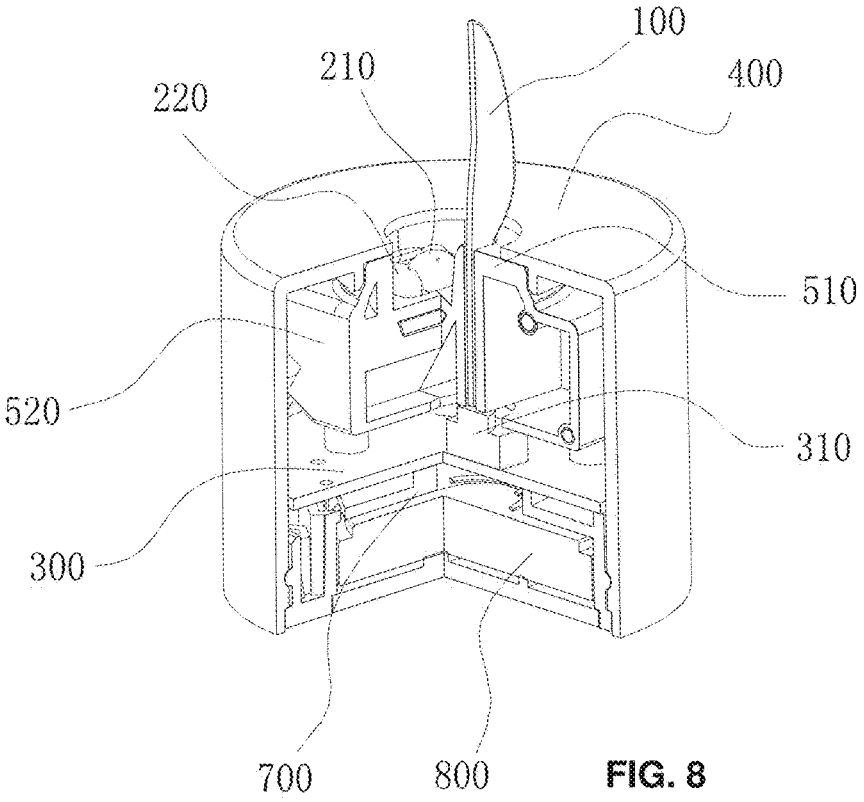
FIG. 8 illustrates exemplary components of an imitation candle device that are positioned under a shell.

In some embodiments, the flame element is formed such that its top portion extends upward parallel to the vertical axis that passes through the top surface of the imitation candle device (e.g., the vertical axis that passes through the center of the imitation candle device) (see e.g., FIGS. 1 and 7). In some embodiments, the top portion of the flame element that protrudes from top of the candle body is curved away from the vertical axis at a small angle. Having such a curved top portion improves the simulation of a real life candle and facilitates proper focusing of the light spots on the flame surface.

One aspect of the disclosed embodiments relate to an imitation candle device. The device comprises a flame element shaped to resemble a candle flame and protruding from top of the imitation candle device; a plurality of light producing devices located within the imitation candle device, each of the plurality of light producing devices, positioned at an angle with respect to a vertical axis that passes through center of the imitation candle device, and configured to project light to illuminate a particular area on the flame element, the plurality of light producing devices positioned to project a set of partially overlapping light beams; a color sensor to detect a color of a surface that the imitation candle device is placed on; and an electronic circuitry coupled to the plurality of light producing devices and the flame element to simulate an appearance of a flame upon projection of the overlapping light beams on the flame element, wherein the electronic circuitry is further coupled to the color sensor to receive a signal indicative of the color of the surface and coupled to a plurality of color lights to adjust color of the imitation candle device based on the color of the surface.

In some embodiments, at least one of the plurality of light producing devices produce an output light having a color temperature in the range of 1690 to 1770° K. In some embodiments, a convex lens is positioned between the plurality of light producing devices and the flame element. In some embodiments, the angle with respect to the vertical axis ranges from 4° to 30°.

In some embodiments, the overlapping light beams form an overlapped area in the center of the flame element and an intensity of each of partially overlapping light beams is modulated by the microcontroller independently.

In some embodiments, the flame element is movable. The flame element starts a swing motion under control of the microcontroller that energizes an electromagnet or a fan. In some embodiments, an upper portion of the movable flame element is lighter than a bottom portion of the movable flame element.

In some embodiments, the plurality of color lights comprise a first color light to produce red light, a second color light to produce green light, and a third color light to produce blue light. the electronic circuitry further comprises an infrared transceiver and a Bluetooth module, the detected color of the surface being communicated to the electronic circuitry via either the infrared transceiver or the Bluetooth module. In some embodiments, the electronic circuitry conducts white balance using a white light before detecting the color of the surface.

Another aspect of the disclosed embodiments relates to a light-emitting control assembly for use in an electronic candle. The assembly comprises a plurality of light producing devices, each of the plurality of light producing devices, positioned at an angle with respect to a vertical axis that passes through center of the light-emitting control assembly and configured to project light to illuminate a particular area of a flame element, wherein the angle is configured to allow the plurality of light producing devices to project a set of partially overlapping light beams; and a circuit board comprising a microcontroller coupled to the plurality of light producing devices and the flame element to simulate an appearance of a flame upon projection of the overlapping light beams on the flame element.

In some embodiments, at least one of the plurality of light producing devices produce an output light having a color temperature between 1690° K to 2350° K. In some embodiments, a lens positioned between the plurality of light producing devices and the flame element to increase the intensity of the light. In some embodiments, the angle with respect to the vertical axis ranges from 4° to 30° and at least one of the plurality of light producing devices projects a beam of green light.

In some embodiments, the overlapping light beams form an overlapped area in the center of the flame element and an intensity of the set of partially overlapping light beams is modulated by the microcontroller.

In some embodiments, the flame element is movable. The flame element starts a swing motion under control of the microcontroller. In some embodiments, an upper portion of the movable flame element is lighter than a bottom portion of the movable flame element.

Some of the embodiments described herein are described in the general context of methods or processes, which may be implemented in one embodiment by a computer program product, embodied in a computer-readable medium, including computer-executable instructions, such as program code, executed by computers in networked environments. A computer-readable medium may include removable and non-removable storage devices including, but not limited to, Read Only Memory (ROM), Random Access Memory (RAM), compact discs (CDs), digital versatile discs (DVD), etc. Therefore, the computer-readable media can include a non-transitory storage media. Generally, program modules may include routines, programs, objects, components, data structures, etc. that perform particular tasks or implement particular abstract data types. Computer- or processor-executable instructions, associated data structures, and program modules represent examples of program code for executing steps of the methods disclosed herein. The particular sequence of such executable instructions or associated data structures represents examples of corresponding acts for implementing the functions described in such steps or processes.

Some of the disclosed embodiments can be implemented as devices or modules using hardware circuits, software, or combinations thereof. For example, a hardware circuit implementation can include discrete analog and/or digital components that are, for example, integrated as part of a printed circuit board. Alternatively, or additionally, the disclosed components or modules can be implemented as an Application Specific Integrated Circuit (ASIC) and/or as a Field Programmable Gate Array (FPGA) device. Some implementations may additionally or alternatively include a digital signal processor (DSP) that is a specialized microprocessor with an architecture optimized for the operational needs of digital signal processing associated with the disclosed functionalities of this application. Similarly, the various components or sub-components within each module may be implemented in software, hardware or firmware. The connectivity between the modules and/or components within the modules may be provided using any one of the connectivity methods and media that is known in the art, including, but not limited to, communications over the Internet, wired, or wireless networks using the appropriate protocols.

The foregoing description of embodiments has been presented for purposes of illustration and description. The foregoing description is not intended to be exhaustive or to limit embodiments of the present invention to the precise form disclosed, and modifications and variations are possible in light of the above teachings or may be acquired from practice of various embodiments. The embodiments discussed herein were chosen and described in order to explain the principles and the nature of various embodiments and its practical application to enable one skilled in the art to utilize the present invention in various embodiments and with various modifications as are suited to the particular use contemplated. The features of the embodiments described herein may be combined in all possible combinations of methods, apparatus, modules, systems, and computer program products.

What is claimed is:

1. An imitation candle device, comprising:

a flame element shaped to resemble a candle flame and protruding from top of the imitation candle device;

a plurality of light producing devices located within the imitation candle device, each light producing device positioned at an inclined angle with respect to a vertical axis of the imitation candle device and configured to project light from a distance onto the flame element including an area of overlapped light beams in a central area of the flame element;

a color sensor located inside the imitation candle device to receive reflected light from a surface that the imitation candle device is placed on and to detect a color of the surface;

one or more colored lighting devices positioned to illuminate an exterior wall of the imitation candle device; and an electronic circuitry coupled to the color sensor, to the plurality of light producing devices and to the one or more colored lighting devices, the electronic circuitry to control projection of light produced by the plurality of light producing devices onto the flame element to simulate an appearance of a candle flame, the electronic circuitry further configured to receive a signal indicative of the color of the surface from the color sensor and to adjust illumination provided to the exterior wall based on the signal indicative of the color of the surface.

2. The imitation candle device of claim 1, wherein at least one of the plurality of light producing devices produces an output light having a color temperature in the range of 1690 to 1770° K.

3. The imitation candle device of claim 1, further comprising a lens positioned between the plurality of light producing devices and the flame element.

4. The imitation candle device of claim 1, wherein an intensity of light for each of the plurality of light producing devices is independently modulated by the electronic circuitry.

5. The imitation candle device of claim 1, wherein the one or more colored lighting devices comprise a first colored lighting device that produces red light, a second colored lighting device that produces green light, and a third colored lighting device that produces blue light.

6. The imitation candle device of claim 1, wherein the electronic circuitry further comprises an infrared transceiver and a Bluetooth module to communicate the signal indicative of the color of the surface to the electronic circuitry via one of the infrared transceiver or the Bluetooth module.

7. The imitation candle device of claim 1, wherein the color sensor comprises an array of photodiodes, a plurality of color filters, and a current-frequency converter.

8. The imitation candle device of claim 1, wherein the color sensor comprises a light-frequency converter.

9. The imitation candle device of claim 1, wherein the electronic circuitry is configured to conduct a white balance procedure to facilitate detection of the color of the surface.

10. The imitation candle device of claim 1, wherein the one or more colored lighting devices are positioned to illuminate an outer shell of the imitation candle device that allows light from the one or more colored lighting devices to be diffused through the outer shell.

11. The imitation candle device of claim 1, the electronic circuitry is configured to modulate light intensity of the plurality of light producing devices in response to receiving signals from a mobile device.

12. A light-emitting control assembly for use in an electronic candle, comprising:

a plurality of light producing devices, each light producing device positioned at an inclined angle with respect to a vertical axis that passes through center of the light-emitting control assembly and configured to project light from a distance onto the flame element to illuminate a particular area of a flame element, wherein the angle is configured to allow the plurality of light producing devices to project a set of overlapping light beams, wherein the overlapping light beams form an overlapped area in a central area of the flame element;

a circuit board comprising a microcontroller coupled to the plurality of light producing devices and the flame element to simulate an appearance of a flame upon projection of the overlapping light beams on the flame element; and one or more colored lighting devices positioned to provide illumination to an exterior wall of the electronic candle.

13. The light-emitting control assembly of claim 12, wherein at least one of the plurality of light producing devices produces an output light having a color temperature between 1690° K to 2350° K.

14. The light-emitting control assembly of claim 12, further comprising a lens positioned between the plurality of light producing devices and the flame element.

15. The light-emitting control assembly of claim 12, wherein the inclined angle with respect to the vertical axis ranges from 4° to 30° .

16. The light-emitting control assembly of claim 12, wherein an intensity of the set of overlapping light beams is modulated by the microcontroller.

17. The light-emitting control assembly of claim 12, wherein at least one of the plurality of light producing devices projects a beam of green light.

18. The light-emitting control assembly of claim 12, wherein the microcontroller is configured to communicate with one or both of an infrared or a Bluetooth transceiver.

19. The light-emitting control assembly of claim 12, wherein the one or more colored lighting devices include a red, a green and a blue colored lighting devices.

* * * * *